US006721536B1

(12) United States Patent
Shimazu

(10) Patent No.: US 6,721,536 B1
(45) Date of Patent: Apr. 13, 2004

(54) ON-DEMAND TYPE RADIO TRANSMITTING/RECEIVING APPARATUS AND METHOD FOR CAR USER

(75) Inventor: Hideo Shimazu, Tokyo (JP)

(73) Assignee: NEC Corporation, Tokyo (JP)

( * ) Notice: Subject to any disclaimer, the term of this patent is extended or adjusted under 35 U.S.C. 154(b) by 679 days.

(21) Appl. No.: 09/663,357

(22) Filed: Sep. 15, 2000

(30) Foreign Application Priority Data

Sep. 17, 1999 (JP) ..... 11-263058

(51) Int. Cl.[7] ..... H04H 1/100
(52) U.S. Cl. ..... 455/3.02; 725/86
(58) Field of Search ..... 455/3.02, 3.07, 455/3.04, 3.05, 3.06, 12.1, 13.1, 456, 427; 375/260; 725/86, 87

(56) References Cited

U.S. PATENT DOCUMENTS 5,898,680 A * 4/1999 Johnstone et al. ..... 370/316
6,490,432 B1 * 12/2002 Wegener et al. ..... 455/3.05
6,553,077 B2 * 4/2003 Rindsberg et al. ..... 375/260

FOREIGN PATENT DOCUMENTS

JP 7-336256 12/1995
JP 08-263410 A 10/1996
JP 09-07790 A 1/1997
JP 09-55673 A 2/1997
JP 10-79711 A 3/1998
JP 10-155140 A 6/1998
JP 11-55634 A 2/1999
JP 11-103450 4/1999
JP 11-187310 A 7/1999

* cited by examiner

*Primary Examiner*—Nay Maung
*Assistant Examiner*—Nick Corsaro
(74) *Attorney, Agent, or Firm*—Sughrue Mion, PLLC

(57) ABSTRACT

In an on-demand type radio transmitting/receiving apparatus, a commercial program stores commercial broadcasting information. A commercial broadcasting device always continuously periodically broadcasts a plurality of commercial programs as a unit. A taste storage device stores a type of information desired by the user. A time storage device holds the latest current time. A position storage device holds the latest position information. An address & longitude/latitude correspondence device incorporates a correspondence table of a normal address and longitude/latitude information and, upon receiving an address as an input, outputs corresponding longitude/latitude information. Upon receiving the commercial program, a commercial program selector compares the classification information, time information, and longitude/latitude information in the commercial program with values in the taste storage device, time storage device, and position storage device, and selects and outputs only a matching commercial program. A reproducer reproduces the content of the commercial program output from the commercial program selector. An on-demand type radio transmitting/receiving method is also disclosed.

8 Claims, 8 Drawing Sheets

ON-DEMAND TYPE RADIO TRANSMITTING/RECEIVING APPARATUS AND METHOD FOR CAR USER

BACKGROUND OF THE INVENTION

The present invention relates to an on-demand type radio transmitting/receiving apparatus and method for a car user and, more particularly, to an on-demand type radio transmitting/receiving apparatus and method for a car user, which use commercial message (CM) broadcasting.

Car navigation systems used in cars are currently becoming popular. Some advanced car navigation systems have a communication function and receive information of restaurants or leisure spots into the car navigation systems through a portable telephone or automobile telephone. Shop information or the like is also recorded on CDs or DVDs, though such information is variable. A car navigation system having a communication function is advantageous because it can cope with the latest information by communication.

Examples of "information services dedicated to information providing for car drivers" are MONET of TOYOTA MOTOR CORP., Compass Link of NISSAN MOTOR Co.Ltd., Internavi of HONDA MOTOR Co.Ltd., ITGS of MERCEDES BENZ, and Mobile Links in which various manufacturers of car navigation systems take part. These services assume bi-directional communication between the service side and the car side.

There is also a "VICS information service". The VICS can load information of traffic jam or regulation, or vacancy information of a parking area onto the navigation window. The VICS uses beacons of two types: light and radio wave transmitted from beacons along trunk roads, and FM radio waves in a wide area. This service is based on one-way communication from the service side to the car side.

In the field of the Internet, a technology called PUSH is widely used. For example, in the mechanism of Pointcast available from Pointcast (see www.pointcast.com), when a user pre-registers the type of necessary information, the user-side PC accesses the WWW server through the Internet at an appropriate timing (e.g., every hour or every day) to automatically acquire the latest information on the WWW server, and the acquired information is presented on the user PC. When viewed from the user side, pieces of information related to desired information designated by the user himself/herself is automatically sequentially provided.

Additionally, "Japanese Patent Laid-Open No. 7-336256" discloses a technique for a traffic information selecting apparatus for a car, which can select a traffic information program on the basis of the latest broadcasting schedule of a receivable broadcasting station in units of areas.

The above-described "information services dedicated to information providing for car drivers" have the following problems.

- The user must pay the charge for the information service.
- The user must pay the charge for the portable telephone.
- These services can provide high-performance functions because of their ability of bi-directional communication but require the user side to do various input operations. This may impede the driving operation while the user is driving.
- The current communication speed is as low as 9,600 bps because of intervention of a digital portable telephone.
- The above "VICS information service" has the following problems.

- Since the VICS is not communication but broadcasting, information providing corresponding to the specific situations of individual users is not available.
- The VICS using an FM radio wave provides only wide-area information while beacons provide more detailed information. To acquire detailed information, the user must purchase a beacon receiver. However, beacon transmitters are installed only along trunk roads.
- The user actually pays the charges for use of the information service by purchasing a special beacon receiver.
- Because the VICS is a public information service, it provides no shop information.

As the first problem of the technique disclosed in "Japanese Patent Laid-Open No. 7-336256", two systems, a pager and broadcasting, are necessary. As the second problem, since broadcasting is not repeated, the user misses information at a high probability (for example, when the car enters a tunnel or the like, information cannot be acquired because no radio wave can be received). As the third problem, only traffic information is available.

To implement an ideal service providing form for a driver, the following two conditions must be satisfied.

First Condition: Adaptive Information for User

Only information corresponding to the situation or taste of the user must be provided. Since most users are driving, the use interface is preferably simple. Possibly, automatic information providing without requiring any operation is convenient. This is a one-way interface such as radio broadcasting. For example, in accordance with the current position, time, and situation of a driver, only necessary information such as "A McDonald's is nearby", "There will be fireworks display in this city in one hour", or "Horyuji Temple Exhibition will be held from today (or from tomorrow) at the Y Museum in the X city nearby" is automatically selected and broadcast. This prevents the driver from operating by himself/herself.

Today, no information providing service adaptive to a person is present in relation to a car navigation system. Even if such a service is provided, it requires a bi-directional communication function, and particularly, the cost for the user increases.

Second Condition: Elimination (or Minimization) of Burden of Cost on User and Reasonable Cost for Provider The user does not want to pay the charge for use. On assumption of this fact, a device such as a portable telephone cannot be used (unless the information providing service side pays the charge for communication). This requires a mechanism advantageous for both the driver side and the information provider side. Currently, TV watching on commercial broadcasting is free for viewers because the broadcasting charge is paid by the CM sponsor. This is because the sponsor recognizes the effect obtained by paying the broadcasting charge. When viewed from a viewer, the commercial broadcasting station broadcasts not only CM films but a program such as a drama attractive for the viewer, and CM films accompanying the program.

Thus, the viewer naturally watches the CM films. If only CM films are available, a busy viewer does not watch the commercial program. Similarly, a mechanism is required with which the CM sponsor can and wants to pay the cost, and the viewer wants to continuously listen to the program (even including the charge). These ideal requirement items for the user side cannot be implemented in any current service.

To satisfy the first condition, the user must register the type of information necessary for himself/herself, and the provider side must provide, to the user, only information required by the user. If only information required by the user is provided, the user need not say "I want it" on demand. For this reason, the user interface is simplified.

The above-described Pointcast is a technology for satisfying the first condition. Although the Pointcast apparently equals TV broadcasting, it presents only information of type designated by the user, while TV broadcasting targets many unspecified viewers. In other words, the Pointcast is broadcasting customized to a person. However, the operation mechanism uses communication. In addition, the user-side PC accesses the WW server. Hence, when this service is used in a car using a portable telephone, the user must pay the charges for use of the portable telephone. That is, the Pointcast is different from broadcasting in implementation.

As long as the current communication infrastructure is used, the second condition cannot be satisfied for both the user side and the information provider side. Even in the U.S.A. market where the cost is lower than in Japan, the typical service for portable telephones is "30 dollars per month guarantees use for 100 hrs at maximum". In Japan, the cost is higher. Even with this charge, information desired by the user is limited. Even for the information provider, the advantage of providing information to individual drivers by paying the charge cannot be easily found.

Hence, these conditions can be satisfied when the cost is reduced using not the communication infrastructure but the broadcasting infrastructure, and a service which can be implemented using only the communication infrastructure is provided.

SUMMARY OF THE INVENTION

It is an object of the present invention to implement broadcasting customized to a person by implementing a PUSH-type information providing mechanism which can be implemented by only a communication infrastructure for a car driver for which the time, position, and the types of necessary contents change as the time elapses (i.e., by repeatedly broadcasting a set of commercial message (CM) programs such that the receiving side can be prevented from executing complex and expensive processing of storing the CM programs in advance and extracting and reproducing them as needed), using a broadcasting infrastructure (without using a pager), simultaneously broadcasting information from the provider to many unspecified persons, and selecting the information on the receiving side in accordance with the TPO (time, place, and occasion).

In order to achieve the above object, according to the present invention, there is provided an on-demand type radio transmitting/receiving apparatus for selecting, from digital satellite radio broadcasting or digital ground radio broadcasting simultaneously broadcast to many unspecified persons, only information which matches a current position and current time of a car driven by a user and matches desired information registered in advance by the user, and presenting the information to the user, comprising a commercial program which stores commercial broadcasting information to which classification information of a content, and time information and position information, which represent effective time and position of the content, respectively, are attached, a commercial broadcasting device which serves as a digital radio broadcasting device on a broadcasting station side, including the digital satellite radio broadcasting or digital ground radio broadcasting, and always continuously periodically broadcasts a plurality of commercial programs as a unit, a taste storage device for storing a type of information desired by the user, a time storage device for holding the latest current time, a position storage device for holding the latest position information, an address & longitude/latitude correspondence device which incorporates a correspondence table of a normal address and longitude/latitude information and, upon receiving an address as an input, outputs corresponding longitude/latitude information, a commercial program selector which receives the commercial program, transfers a value representing an address as position information in the commercial program to the address & longitude/latitude correspondence device, receives longitude/latitude information converted from the address, compares the classification information, time information, and longitude/latitude information in the commercial program with values in the taste storage device, time storage device, and position storage device, and selects and outputs only a matching commercial program, and a reproducer for reproducing the content of the commercial program output from the commercial program selector.

DESCRIPTION OF THE PREFERRED EMBODIMENTS

The principle of the present invention will be described first with reference to the accompanying drawings.

Figure 5:
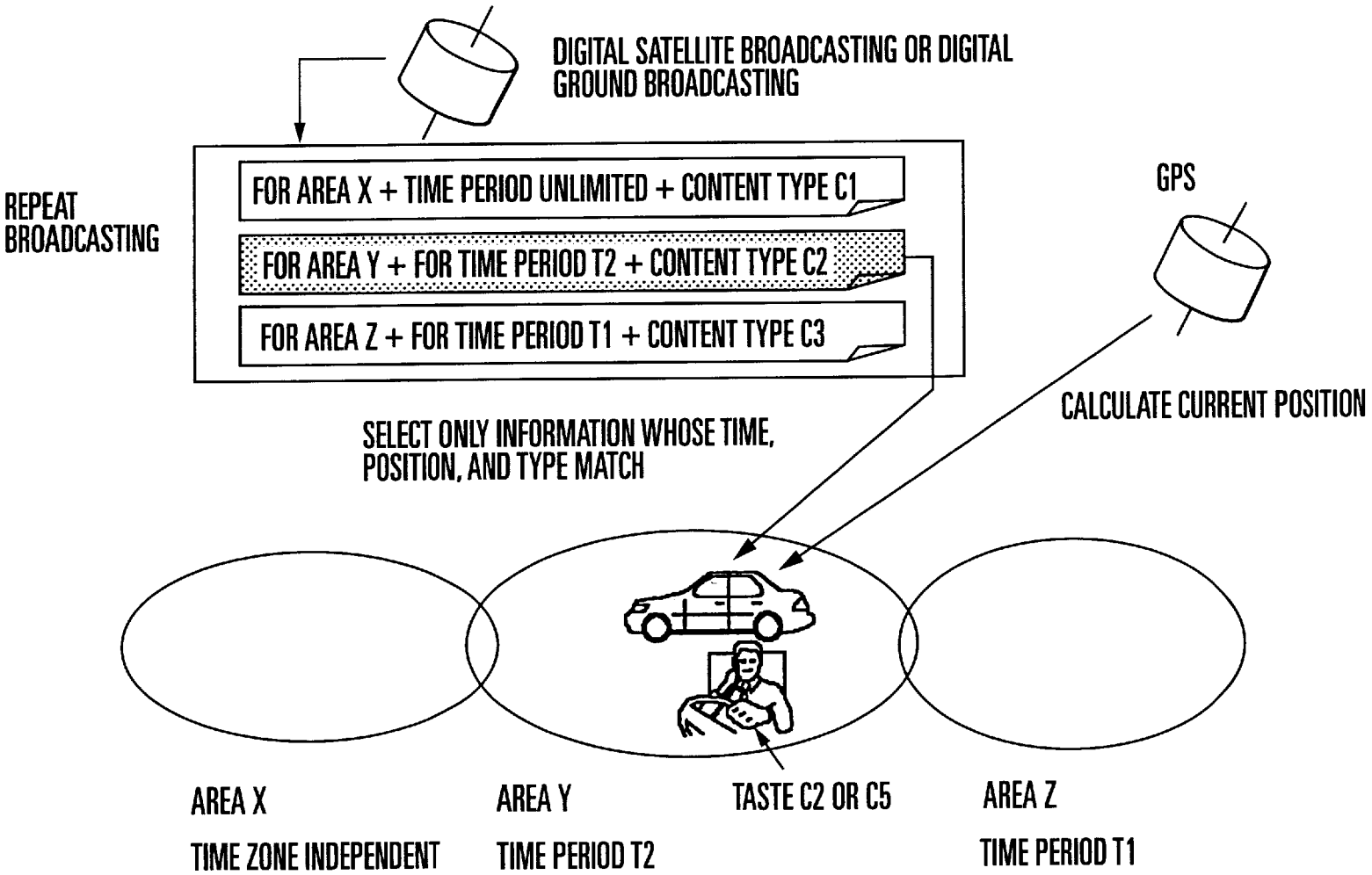
FIG. 5 is an explanatory view showing the principle of the present invention.

FIG. 5 shows the principle of the present invention.

Referring to FIG. 5, in the present invention, a set of a plurality of CM programs each incorporating the position, time, and content (e.g., position: for area X, time: time zone independent, and content: content type C1) is repeatedly simultaneously broadcast by digital satellite broadcasting or digital ground broadcasting. For example, for a freeway area in the middle west district of the U.S.A. with boundless expanse of cornfield, the number of CM provides is small, and a considerably wide region is defined as one area. Near Silicon Valley, where different restaurants, shopping malls, and convenience stores are present in units of exits of freeway, and these shops may provide CMs, a considerably narrow area is preferably defined as one area (e.g., as large as Silicon Valley).

The taste information contents of the user are registered and held in the onboard device in advance. In addition to the taste information contents, the current time is acquired from a clock, and the current position is acquired from a GPS. Using these pieces of information, only information matching the taste information contents, current time, and current position is selected from the simultaneously broadcast CM programs and presented to the user.

This implements the proposal such as "A McDonald's is nearby", "There will be a fireworks display in this city in one hour", or "Horyuji Temple Exhibition will be held from today (or from tomorrow) at the Y Museum in the X city nearby".

When coupon information is added to this information, the effect of these CMs can also be measured. For example, a message "A McDonald's is near the next exit. We will discount 50 cents for those who say a keyword ABC at the counter" is presented. The effect of this CM can be known by measuring the number of persons who said ABC at the shop.

The program of a CM program will be described next with reference to the accompanying drawings.

Figure 6:
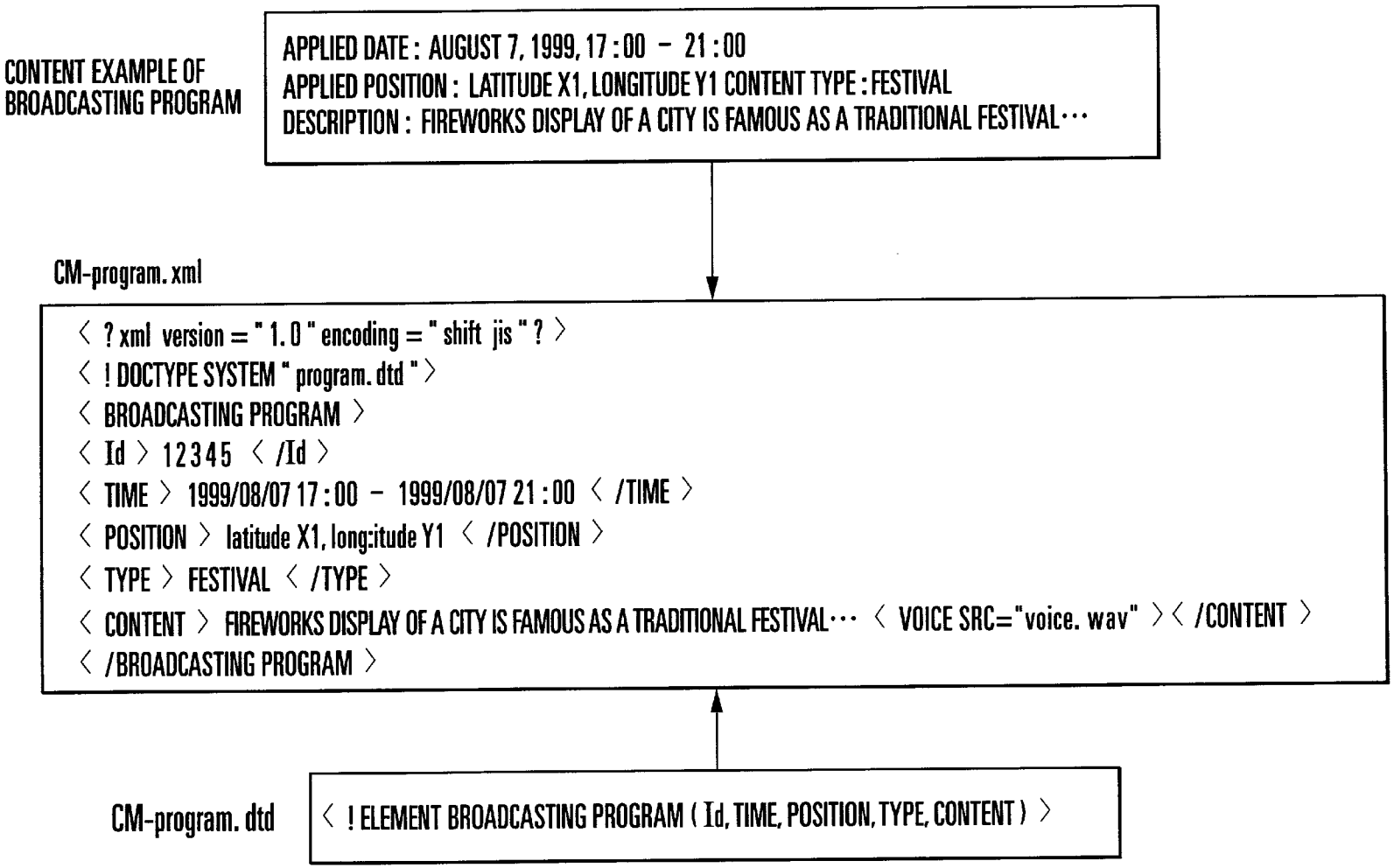
FIG. 6 is an explanatory view showing the contents of a CM program.

FIG. 6 shows the contents of a CM program.

The contents of a CM program to be broadcast by digital broadcasting can be expressed by, e.g., the XML (Extensible Markup Language) that has been recently popularly used in the field of WWW. The XML can express the contents of a document using a set of pairs of attribute tags and their attribute values (see the home page of World Wide Web Consortium, "Extensible Markup Language 1.0", http://www.w3.org/TR/PR-xml-971208).

The specifications of the XML have been proposed in December 1997 by the World Wide Web Consortium (see the home page of World Wide Web Consortium, http://www.w3.org) that is an organization for determining the standards of the WWW.

Referring to FIG. 6, a CM program is described by the XML. In the XML, the document format is defined by a DTD file (CM-program.dtd). The format "CM-program" has fields <time>, <position>, <type>, and <content>. The contents of individual CM programs are stored in different XML files, respectively. Referring to FIG. 6, the information of a fireworks display is described in an XML file (CM-program.xml) in accordance with a format designated by the CM-program.dtd.

<Voice SRC="voice.wav">in <content> of CM-program.xml indicates a voice file "voice.wav" in which the description of fireworks display is recorded. This file is broadcast together with CM-program.xml.

For example, when the user registers information of "festival" in advance as taste information and visits A city at 17:00 to 21:00 in Aug. 17, 1999, this information is presented to the driver. Matching between the current time and the time information in the CM program is easy.

Referring to FIG. 6, the position information in the CM program is represented as longitude/latitude information. When the current position information is acquired from the GPS, matching therefor is easy, too. The content type information in the CM program can also easily match when a finite number of types are defined in advance, and one information is selected from these pieces of information.

The first embodiment of the present invention will be described next with reference to the accompanying drawings.

Figure 1:
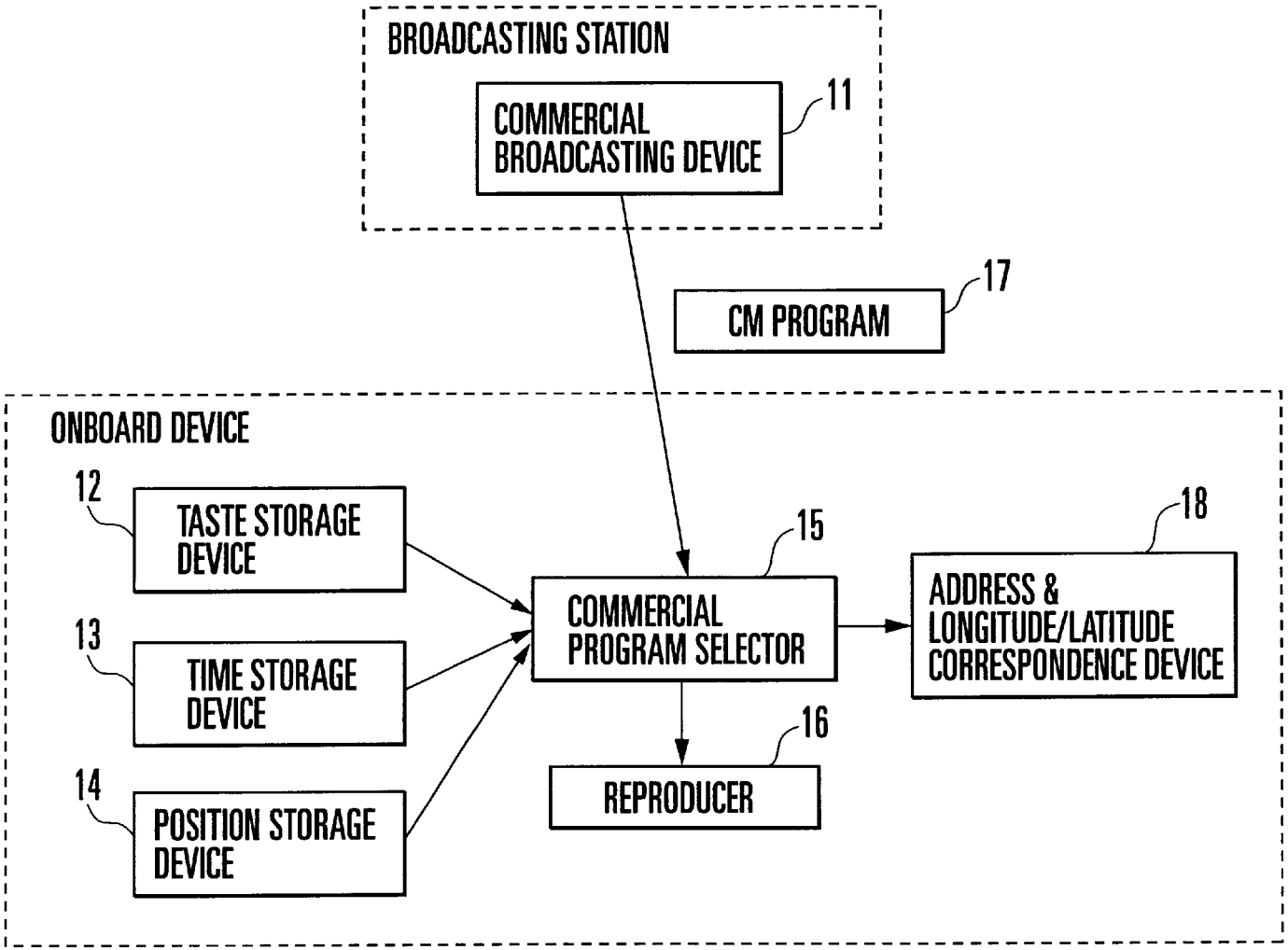
FIG. 1 is a block diagram showing a radio transmitting/receiving apparatus according to the first embodiment of the present invention.

FIG. 1 shows the first embodiment of the present invention.

Referring to FIG. 1, the first embodiment of the present invention comprises a CM broadcasting device 11 and CM program 17, which are installed in a broadcasting station for digital ground broadcasting or in an artificial satellite for digital satellite broadcasting, and a taste storage device 12, time storage device 13, position storage device 14, CM program selector 15, reproducer 16, and address & longitude/latitude correspondence device 18, which are installed in a car.

The CM program 17 is described in XML and has <time>, <position>, <type>, and <content> fields. The time when this CM program is effective is described in <time>. The position related to this CM program is described in <position>. The content classification code (e.g., restaurant, convenience store, shopping mall, home center, hospital, amusement park, or museum) of this CM program is described in <type>.

For example, when a certain restaurant will be a sponsor and advertise special sale in lunch time, the period of lunch time is described in <time>, the address of the restaurant is described in <position>, and the "restaurant" is described in <type>. In addition, a description representing a voice file which holds the contents of special sale is stored in <content>.

If this restaurant wants to broadcast only normal restaurant information without special sale in specific lunch time, "anytime" is described in <time>. Not information of time level but information of month/day level may be described in <time>. For example, for a special exhibition at a certain museum, <(date of start) to (date of end)> is described.

The operation of the first embodiment of the present invention will be described next.

Figure 7:
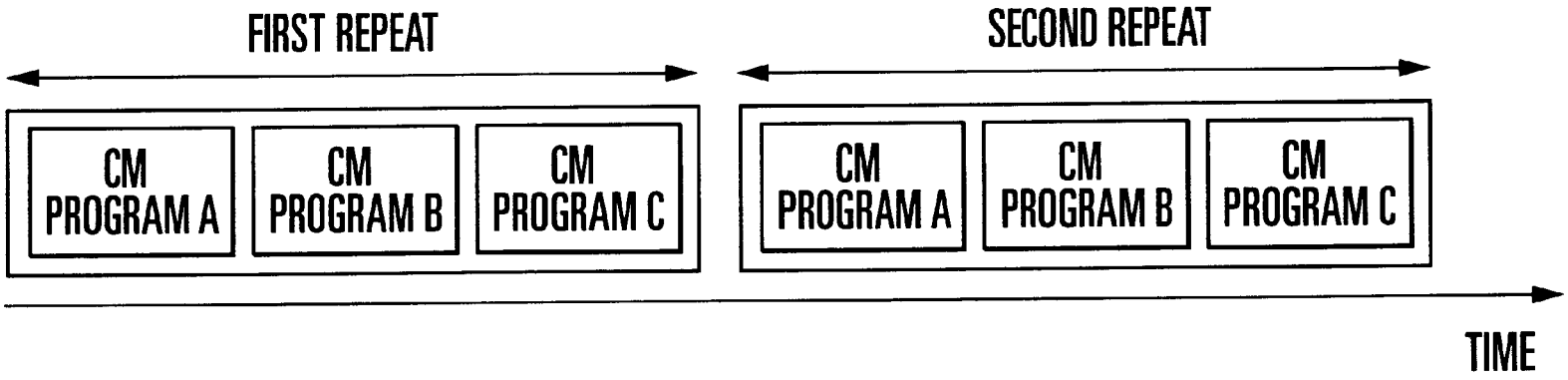
FIG. 7 is an explanatory view showing the operation of the radio transmitting/receiving apparatus shown in FIG. 1.

FIG. 7 shows the operation of the first embodiment of the present invention.

Referring to FIG. 7, the CM broadcasting device 11 repeatedly periodically broadcasts a set of a plurality of CM programs A, B, and C.

The information type wanted by the user is stored in the taste storage device 12 by the user. This information has the same value as that stored in <type> in the CM program 17. Current time read from a clock (not shown) is automatically stored in the time storage device 13. This time updated, e.g., every minute.

Current position information read out from the GPS (FIG. 5) is stored in the position storage device 14 in the form of longitude and latitude. This information is also updated, e.g., every minute. When an address is given, the address & longitude/latitude correspondence device 18 converts the address into longitude/latitude information. As a simple implementation method, in targeting Japan, items are prepared in units of address levels of cities, towns, and villages of Japan, longitude/latitude information corresponding to each item is stored in a table, the table is searched using address data of address level as a key, thereby converting the address into longitude/latitude information.

The CM program selector 15 receives each unit of the CM program 17 broadcast from the CM broadcasting device 11, compares the descriptions in <type>, <time>, and <position> with the values in the taste storage device 12, time storage device 13, and position storage device 14, respectively, and outputs and transfers only a matching CM program to the reproducer 16.

The reproducer 16 extracts the value in <content> field in the received CM program 17 and reproduces it.

The second embodiment of the present invention will be described next with reference to the accompanying drawings.

Figure 2:
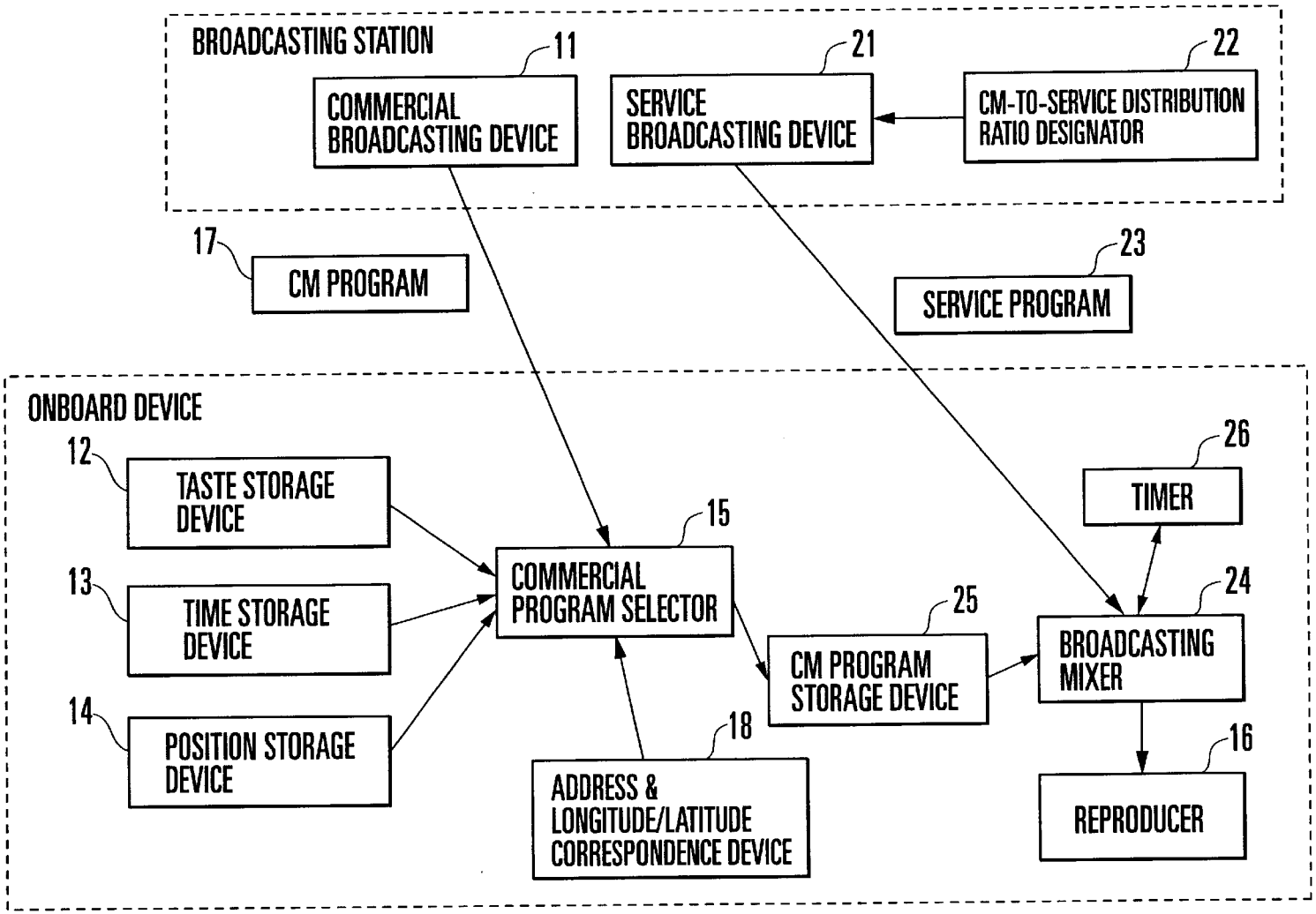
FIG. 2 is a block diagram showing a radio transmitting/receiving apparatus according to the second embodiment of the present invention.

FIG. 2 shows the second embodiment of the present invention.

In the second embodiment of the present invention, a function is added to the first embodiment of the present invention. More specifically, a CM program and service program are combined. This is a method employed by commercial TVs. To users, charge-free service programs such as a classical music channel and popular song channel are provided, and CM programs are broadcast for 5 min per 30 min.

Referring to FIG. 2, the second embodiment of the present invention comprises a CM broadcasting device 11, CM program 17, service broadcasting device 21, CM-to-service distribution ratio designator 22, and service program 23, which are installed in a broadcasting station for digital ground broadcasting or in an artificial satellite for digital satellite broadcasting, and a taste storage device 12, time storage device 13, position storage device 14, CM program selector 15, reproducer 16, address & longitude/latitude correspondence device 18, broadcasting mixer 24, CM program storage device 25, and timer 26, which are installed in a car.

The CM broadcasting device 11 to address & longitude/latitude correspondence device 18 are the same as those of the first embodiment of the present invention (FIG. 1). However, the output from the CM program selector 15 is not directly sent to the reproducer 16 but temporarily stored in the CM program storage device 25.

The operation of the second embodiment of the present invention will be described next.

Figure 8:
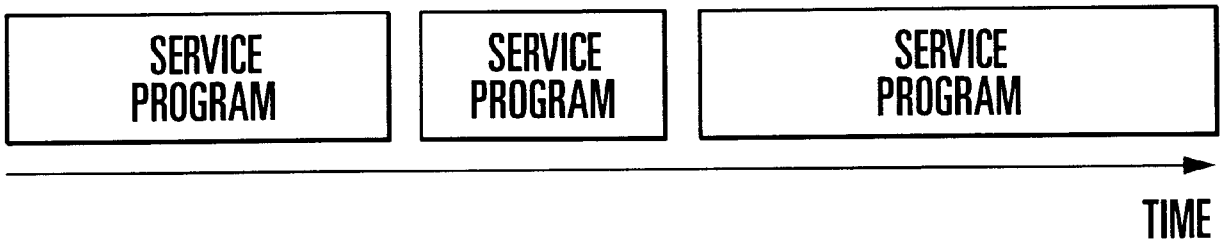
FIG. 8 is an explanatory view showing the operation of the radio transmitting/receiving apparatus shown in FIG. 2.
Figure 9:
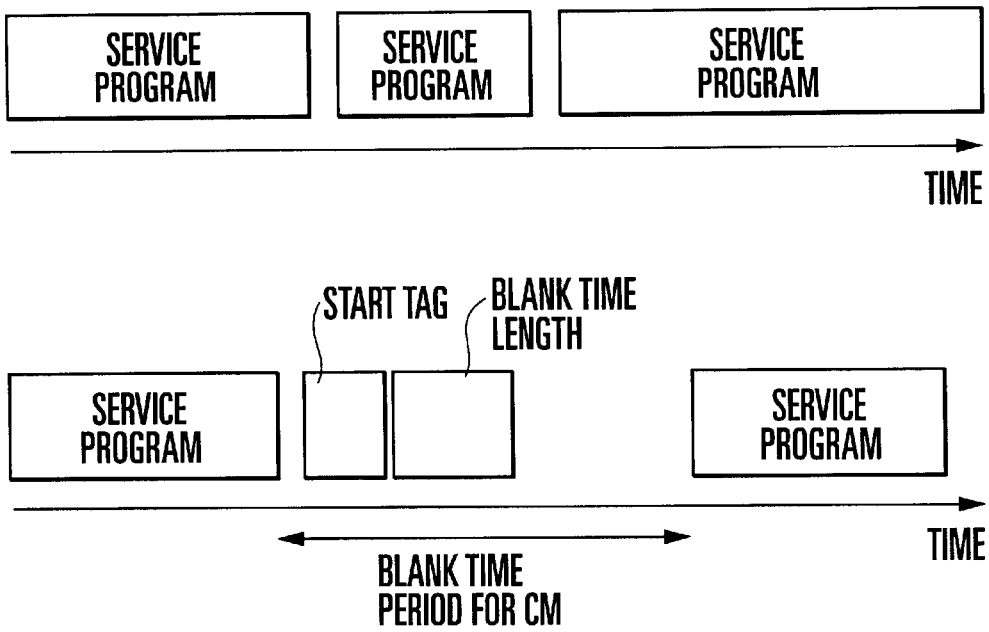
FIG. 9 is an explanatory view showing the operation of the radio transmitting/receiving apparatus shown in FIG. 2.

FIGS. 8 and 9 show the operation of the second embodiment of the present invention.

In the second embodiment of the present invention, the CM program 17 is combined with the service program 23, as described above. The service broadcasting device 21 broadcasts digital data, like the CM broadcasting device 11. If the service should distribute classical music, the service program 23 is a classical music program. That is, the service broadcasting device 21 continuously broadcasts classical music.

Unlike the CM program 17, the service program 23 need not have special field information. However, the service program 23 may store the type of information such that the user's taste can also be reflected to this program.

Referring to FIG. 8, the service broadcasting device 21 does not periodically repeat a plurality of service programs. That is, the service broadcasting device 21 sequentially broadcasts different programs, as in normal radio programs.

The CM-to-service distribution ratio designator 22 stores the distribution ratio of the service program 23 to the CM program 17. For example, to distribute programs at a ratio of 50 min of service programs to 10 min of CM programs, a value "5:1" is stored.

In accordance with this ratio, the service programs are distributed with a blank time period for CM distribution, as shown in FIG. 9. A "start tag" representing the boundary between the service program and the blank time period and "blank time length" representing the length of the blank time period are inserted to the boundary.

The broadcasting mixer 24 normally receives the service program 23 transmitted from the service broadcasting device 21 and directly transfers it to the reproducer 16. The reproducer 16 directly reproduces the service program 23. Upon detecting the "start tag" representing the blank time period for CM distribution from the service broadcasting device 21, the broadcasting mixer 24 sets the blank time length in the timer 26 and activates it. Then, the broadcasting mixer 24 extracts the CM program 17 stored in the CM program storage device 25 and transfers the CM program 17 to the reproducer 16.

The timer 26 counts down, and when it is the end of blank time, notifies the broadcasting mixer 24 of it. The broadcasting mixer 24 stops extracting the CM program 17 from the CM program storage device 25 and resumes reception of the service program 23 from the service broadcasting device 21 and transfer to the reproducer 16.

The third embodiment of the present invention will be described next in detail with reference to the accompanying drawings.

Figure 3:
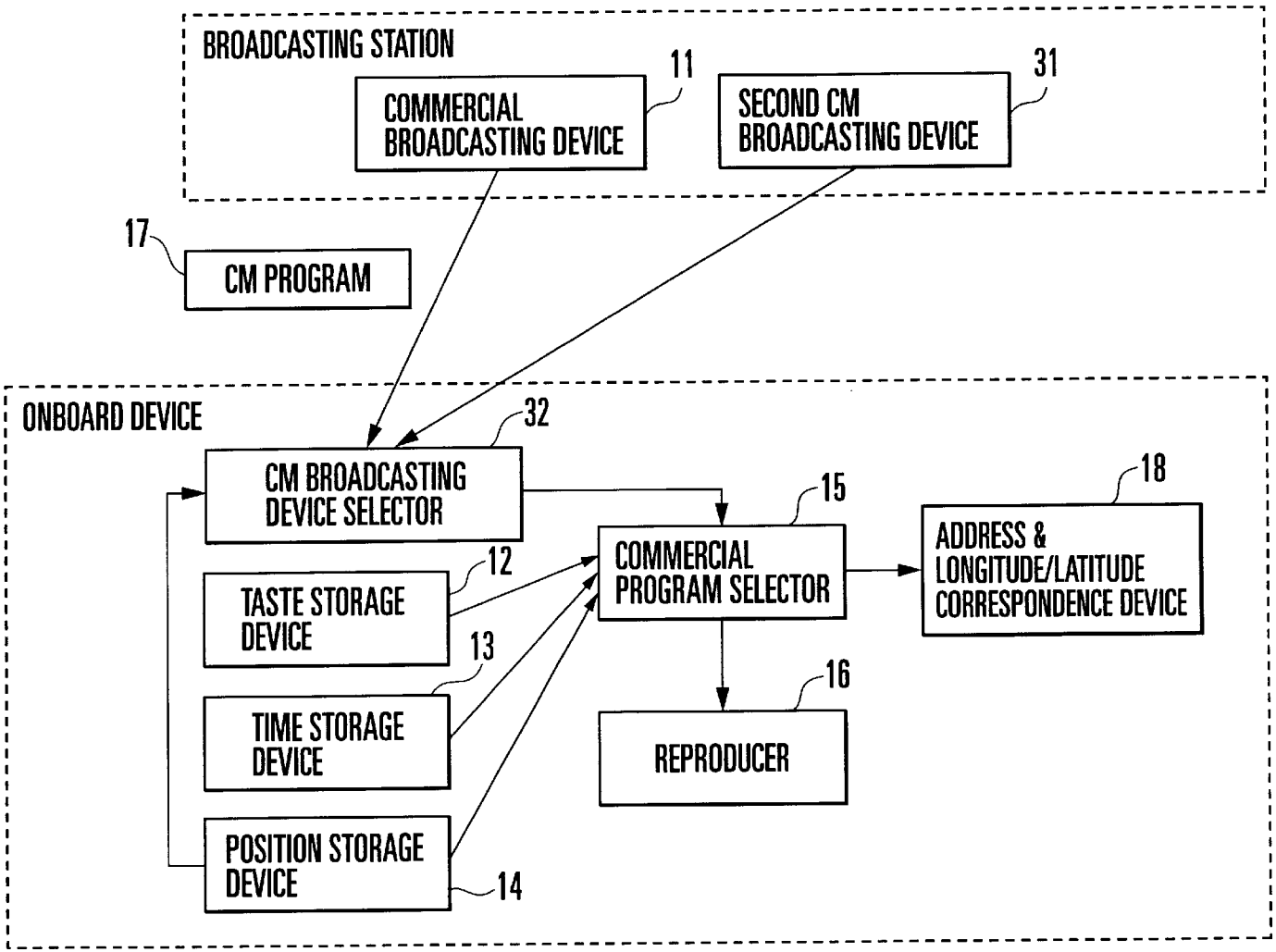
FIG. 3 is a block diagram showing a radio transmitting/receiving apparatus according to the third embodiment of the present invention.

FIG. 3 shows the third embodiment of the present invention.

In the third embodiment of the present invention, a function is added to the first embodiment of the present invention.

Referring to FIG. 3, the third embodiment of the present invention comprises a CM broadcasting device 11, second CM broadcasting device 31, and CM program 17, which are installed in a broadcasting station for digital ground broadcasting or in an artificial satellite for digital satellite broadcasting, and a taste storage device 12, time storage device 13, position storage device 14, CM program selector 15, reproducer 16, address & longitude/latitude correspondence device 18, and CM broadcasting device selector 32, which are installed in a car.

The value in the position storage device 14 is transferred to not only the CM program selector 15 but also the CM broadcasting device selector 32. A CM program transmitted from the CM broadcasting device 11 is not directly transferred to the CM program selector 15 but received by the CM broadcasting device selector 32.

The second CM broadcasting device 31 has the same arrangement as that of the CM broadcasting device 11, though areas in charge of the devices are different. Two or more CM broadcasting devices can be installed. In a region where cities concentrate, like San Francisco or Kanto Area, different CM broadcasting devices may be prepared as separate channels in units of cities, districts, or smaller units.

The operation of the third embodiment of the present invention will be described next.

The CM broadcasting device selector 32 incorporates a correspondence table of position information, the CM broadcasting device 11 and second CM broadcasting device 31 to be selected. Upon receiving current position information indicated by the position storage device 14, the CM broadcasting device selector 32 determines which channel is to be selected, the CM broadcasting device 11 or second CM broadcasting device 31, receives the CM program 17 of the selected channel, and transfers the CM program to the CM program selector 15. The CM program selector 15 compares <type>, <time>, and <position> described in the CM program 17 with the values in the taste storage device 12, time storage device 13, and position storage device 14, respectively, and outputs and transfers only a matching CM program to the reproducer 16. The reproducer 16 extracts the value in <content> field in the received CM program 17 and reproduces it.

Thus, the CM program 17 can be provided using a plurality of channels. When the number of providers of CM programs 17 is large in the urban region, different CM broadcasting channels are assigned in units of areas. For example, channel 1 is assigned to area 1, and channel 2 is assigned to area 2. When the car moves from an area to another area, the channel is switched to a corresponding channel, thereby frequently repeating the CM program 17.

The fourth embodiment of the present invention will be described next in detail with reference to the accompanying drawings.

Figure 4:
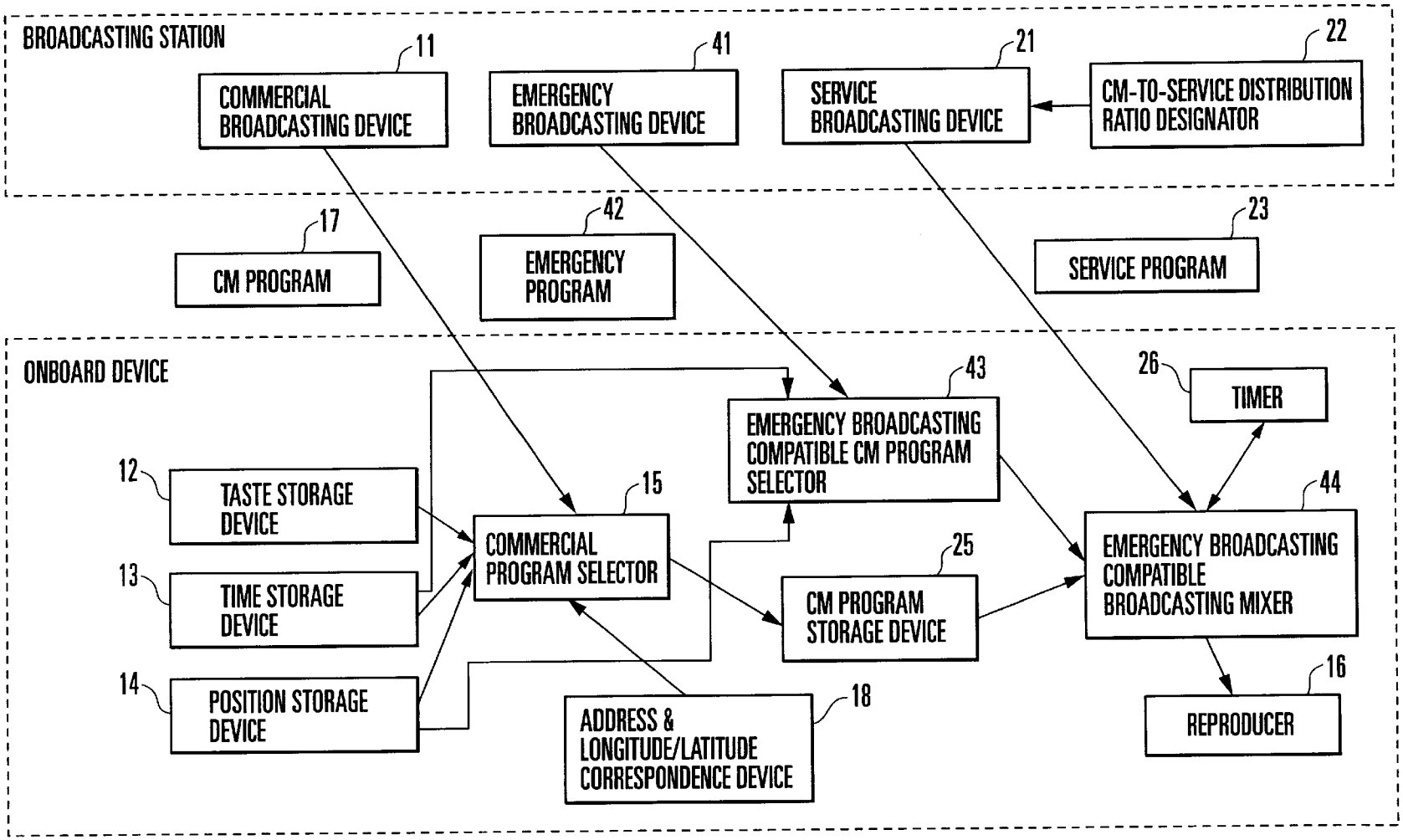
FIG. 4 is a block diagram showing a radio transmitting/receiving apparatus according to the fourth embodiment of the present invention.

FIG. 4 shows the fourth embodiment of the present invention.

In the fourth embodiment of the present invention, the function of an emergency broadcasting channel is added to the second embodiment of the present invention. More specifically, a channel for broadcasting an accident or earthquake/tidal wave warning in the area is prepared. Such information is broadcast by interrupting a service program or CM broadcasting. This mechanism is the same as that of announcement in aircraft: music program broadcasting is interrupted by a message from the captain, "We are expecting a little turbulence. Would you make sure that your seat belt is fastened".

Referring to FIG. 4, the fourth embodiment of the present invention comprises a CM broadcasting device 11, CM program 17, service broadcasting device 21, CM-to-service distribution ratio designator 22, service program 23, emergency broadcasting device 41, and emergency program 42, which are installed in a broadcasting station for digital ground broadcasting or in an artificial satellite for digital satellite broadcasting, and a taste storage device 12, time storage device 13, position storage device 14, CM program selector 15, reproducer 16, address & longitude/latitude correspondence device 18, CM program storage device 25, timer 26, emergency broadcasting compatible CM program selector 43, and emergency broadcasting compatible broadcasting mixer 44, which are installed in a car.

The fourth embodiment is different from the second embodiment of the present invention also in that the values in the time storage device 13 and position storage device 14 are transferred to not only the CM program selector 15 but also the emergency broadcasting compatible CM program selector 43, and the broadcasting mixer 24 is replaced with the emergency broadcasting compatible broadcasting mixer 44. The emergency broadcasting device 41 has the same mechanism as that of the CM broadcasting device 11 or service broadcasting device 21.

The operation of the fourth embodiment of the present invention will be described next.

Figure 10:
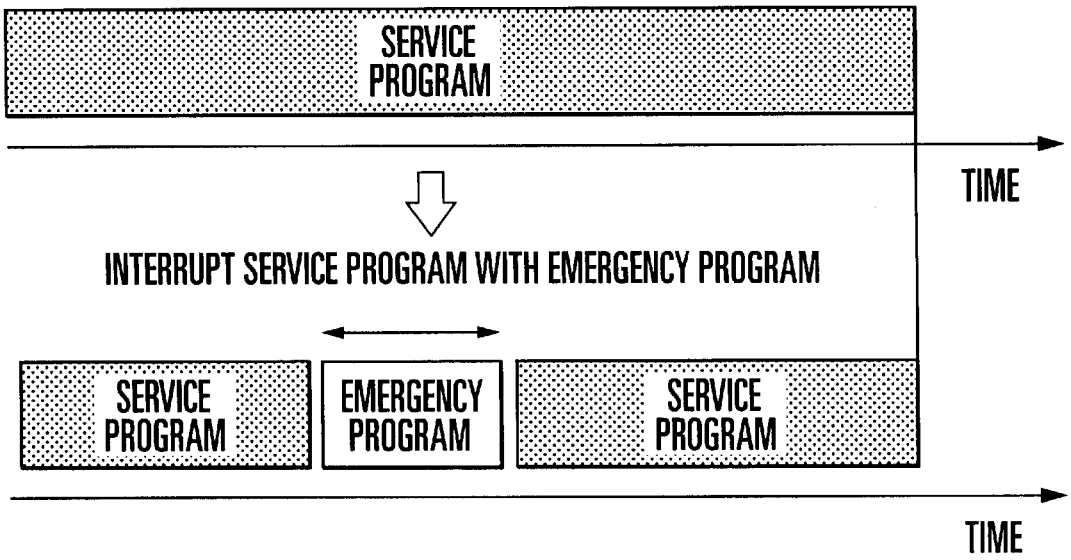
FIG. 10 is an explanatory view showing the operation of the radio transmitting/receiving apparatus shown in FIG. 4.

FIG. 10 shows the operation of the fourth embodiment of the present invention.

The emergency broadcasting device 41 broadcasts the emergency program 42 only when there is emergency information. The emergency program 42 is formed from <time>, <position>, <type>, and <content>, like the CM program 17. In this case, a type value "emergency" is stored in <type>. Target time information and target position information related to the contents of emergency are stored in <time> and <position>. Voice data of the emergency contents themselves is stored in <content>.

The emergency broadcasting compatible CM program selector 43 receives the radio wave from the emergency broadcasting device 41. Upon receiving the emergency program 42, the emergency broadcasting compatible CM program selector 43 compares the values in the <time> and <position> fields of the emergency program 42 with the values in the time storage device 13 and position storage device 14. If the values match, the emergency program 42 is transferred to not the CM program storage device 25 but the emergency broadcasting compatible broadcasting mixer 44.

The emergency broadcasting compatible broadcasting mixer 44 normally operates like the broadcasting mixer 24 of the second embodiment of the present invention. However, when the emergency program 42 is directly received from the emergency broadcasting compatible CM program selector 43, the emergency broadcasting compatible broadcasting mixer 44 forcibly interrupts the current broadcasting contents, the service program 23 or CM program 17, and transfers the emergency program 42 to the reproducer 16.

The reproducer 16 reproduces the voice data in the <content> field of the received emergency program 42. As shown in FIG. 10, this interrupt processing is forcibly done. If the service program 23 is being broadcast, the contents of the service program 23 during the interrupt are discarded.

The blocks of the first to fourth embodiments of the present invention can be implemented as procedures. That is, each embodiment can be implemented as an on-demand type radio transmitting/receiving method for a car user.

An apparatus for an automobile has been described above. However, the apparatus can also be applied to a motorcycle, bicycle, tricycle, or the like.

As the first effect of the present invention, adaptive information to the user can be provided while eliminating the burden of cost on the user and achieving reasonable cost for the provider by broadcasting infrastructure without using any expensive infrastructure for the user, such as a portable telephone. More specifically, a PUSH-type information providing mechanism which can be implemented by only a communication infrastructure for a car driver for which the time, position, and the types of necessary contents change as the time elapses can be implemented.

In addition, it is very effective as a marketing strategy because horizontal development including restaurants, hotels, shopping malls, and hospitals is enabled.

As the second effect of the present invention, the device arrangement is simple. This is because no pager is used.

As the third effect of the present invention, the user misses information at low probability. This is because the same information is repeatedly broadcast.

What is claimed is:

1. An on-demand type radio transmitting/receiving apparatus for selecting, from digital satellite radio broadcasting or digital ground radio broadcasting simultaneously broadcast to many unspecified persons, only information which matches a current position and current time of a car driven by a user and matches desired information registered in advance by the user, and presenting the information to the user, comprising:

a commercial program which stores commercial broadcasting information to which classification information of a content, and time information and position information, which represent effective time and position of the content, respectively, are attached;

a commercial broadcasting device which serves as a digital radio broadcasting device on a broadcasting station side, including the digital satellite radio broadcasting or digital ground radio broadcasting, and always continuously periodically broadcasts a plurality of commercial programs as a unit;

a taste storage device for storing a type of information desired by the user;

a time storage device for holding the latest current time;

a position storage device for holding the latest position information;

an address & longitude/latitude correspondence device which incorporates a correspondence table of a normal address and longitude/latitude information and, upon receiving an address as an input, outputs corresponding longitude/latitude information;

a commercial program selector which receives the commercial program, transfers a value representing an address as position information in the commercial program to said address & longitude/latitude correspondence device, receives longitude/latitude information converted from the address, compares the classification information, time information, and longitude/latitude information in the commercial program with values in said taste storage device, time storage device, and position storage device, and selects and outputs only a matching commercial program; and a reproducer for reproducing the content of the commercial program output from said commercial program selector.

2. An apparatus according to claim 1, wherein said apparatus further comprises a service program which stores information available for the user, a commercial-to-service distribution ratio designator for storing a ratio of a broadcasting time of the service program to that of the commercial program, a service broadcasting device which sequentially broadcasts service programs, sets, between the service programs, a blank time calculated on the basis of the ratio designated by said commercial-to-service distribution ratio designator, in which no broadcasting wave is transmitted, broadcasts an identifier representing a start of the blank time and length information of the blank time at the start of the blank time, and after an elapse of the time designated by the length information, in which no broadcasting wave is transmitted, broadcasts the next service program, a commercial program storage device for storing the commercial program output from said commercial program selector, a timer for starting measuring time when a set time is set, and transmitting an end event after an elapse of the set time, and a broadcasting mixer which normally receives the service program transmitted from said service broadcasting device, directly transfers the service program to said reproducer, upon detecting the identifier representing the start of the blank time between the service programs, sets the length information of the blank time in said timer, activates said timer, extracts the commercial programs stored in said commercial program storage device one by one, and transfers the commercial programs to said reproducer until the end event of the timer is detected; and said reproducer reproduces the service program and commercial program transferred from said broadcasting mixer.

3. An apparatus according to claim 1, wherein said apparatus further comprises a second commercial broadcasting device which is assigned, in units of regions, to commercial information belonging to each region to periodically broadcast the commercial program independently of said commercial broadcasting device, and a commercial broadcasting device selector which receives the user's current position held in said position storage device, determines whether said commercial broadcasting device or said second commercial broadcasting device is assigned to a region to which the current position belongs, receives the commercial program on the assigned side, and transfers the commercial program to said commercial program selector; and said commercial program selector receives the commercial program from said commercial broadcasting device selector, transfers the value representing the address as the position information in the commercial program to said address & longitude/latitude correspondence device, receives longitude/latitude information converted from the address, compares the classification information, time information, and longitude/latitude information in the commercial program with the values in said taste storage device, time storage device, and position storage device, and selects and outputs only a matching commercial program.

4. An apparatus according to claim 2, further comprising:

an emergency program having the same expression format as that of the commercial program and representing emergency information including accident information and earthquake/tidal wave information;

an emergency broadcasting device which has the same mechanism as that of said commercial broadcasting device and broadcasts the emergency program only when emergency information is present;

an emergency broadcasting program selector which receives the emergency program from said emergency broadcasting device, compares time information and position information contained in the emergency program with the values in said time storage device and position storage device, respectively, and selects and outputs the matching emergency program; and an emergency broadcasting compatible broadcasting mixer which is provided in place of said broadcasting mixer, normally executes the same processing as that of said broadcasting mixer, and upon receiving the emergency program from said emergency broadcasting compatible commercial program selector, forcibly interrupts contents which are currently being broadcast to transfer the emergency program to said reproducer.

5. An on-demand type radio transmitting/receiving method of selecting, from digital satellite radio broadcasting or digital ground radio broadcasting simultaneously broadcast to many unspecified persons, only information which matches a current position and current time of a car driven by a user and matches desired information registered in advance by the user, and presenting the information to the user, comprising the steps of:

causing a commercial broadcasting device serving as a digital radio broadcasting device on a broadcasting station side, including the digital satellite radio broadcasting or digital ground radio broadcasting to always continuously periodically broadcast a plurality of commercial programs as a unit, the commercial program storing commercial broadcasting information to which classification information of a content, and time information and position information, which represent effective time and position of the content, respectively, are attached;

storing a type of information desired by the user in a taste storage device;

holding the latest current time in a time storage device;

holding the latest position information in a position storage device;

causing an address & longitude/latitude correspondence device to incorporate a correspondence table of a normal address and longitude/latitude information and, upon receiving an address as an input, output corresponding longitude/latitude information;

causing a commercial program selector to receive the commercial program, transfer a value representing an address as position information in the commercial program to the address & longitude/latitude correspondence device, receive longitude/latitude information converted from the address, compare the classification information, time information, and longitude/latitude information in the commercial program with values in the taste storage device, time storage device, and position storage device, and select and output only a matching commercial program; and causing a reproducer to reproduce the content of the commercial program output from the commercial program selector.

6. A method according to claim 5, further comprising the steps of:

causing a commercial-to-service distribution ratio designator to store a ratio of a broadcasting time of a service program to that of the commercial program, the service program storing information available for the user;

causing a service broadcasting device to sequentially broadcast service programs, set, between the service programs, a blank time calculated on the basis of the ratio designated by the commercial-to-service distribution ratio designator, in which no broadcasting wave is transmitted, broadcast an identifier representing a start of the blank time and length information of the blank time at the start of the blank time, and after an elapse of the time designated by the length information, in which no broadcasting wave is transmitted, broadcast the next service program;

causing a commercial program storage device to store the commercial program output from the commercial program selector;

causing a timer to start measuring time when a set time is set, and transmit an end event after an elapse of the set time;

causing a broadcasting mixer to normally receive the service program transmitted from the service broadcasting device, directly transfer the service program to the reproducer, detect the identifier representing the start of the blank time between the service programs, set the length information of the blank time in the timer, activate the timer, extract the commercial programs stored in the commercial program storage device one by one, and transfer the commercial programs to the reproducer until the end event of the timer is detected; and causing the reproducer to reproduce the service program and commercial program transferred from the broadcasting mixer.

7. A method according to claim 5, further comprising the steps of:

assigning a second commercial broadcasting device, in units of regions, to commercial information belonging to each region and causing the second commercial broadcasting device to periodically broadcast the commercial program independently of the commercial broadcasting device;

causing a commercial broadcasting device selector to receive the user's current position held in the position storage device, determine whether the commercial broadcasting device or the second commercial broadcasting device is assigned to a region to which the current position belongs, receive the commercial program on the assigned side, and transfer the commercial program to the commercial program selector; and causing the commercial program selector to receive the commercial program from the commercial broadcasting device selector, transfer the value representing the address as the position information in the commercial program to the address & longitude/latitude correspondence device, receive longitude/latitude information converted from the address, compare the classification information, time information, and longitude/latitude information in the commercial program with the values in the taste storage device, time storage device, and position storage device, and select and output only a matching commercial program.

8. A method according to claim 6, further comprising the steps of:

causing an emergency broadcasting device which has the same mechanism as that of the commercial broadcasting device to broadcast an emergency program only when emergency information is present, the program having the same expression format as that of the commercial program and representing emergency information including accident information and earthquake/tidal wave information;

causing an emergency broadcasting program selector to receive the emergency program from the emergency broadcasting device, compare time information and position information contained in the emergency program with the values in the time storage device and position storage device, respectively, and select and output the matching emergency program; and causing an emergency broadcasting compatible broadcasting mixer provided in place of the broadcasting mixer to normally execute the same processing as that of the broadcasting mixer, receive the emergency program from the emergency broadcasting compatible commercial program selector, and forcibly interrupt contents which are currently being broadcast to transfer the emergency program to the reproducer.

* * * * *